US005797758A

United States Patent [19]

Tsuchiya et al.

[11] Patent Number: 5,797,758

[45] Date of Patent: Aug. 25, 1998

[54] LEVER ACTION-TYPE FEMALE CONNECTOR

[75] Inventors: Shinichi Tsuchiya; Kazuhisa Ishizaki, both of Shizuoka-ken, Japan

[73] Assignee: Yazaki Corporation, Tokyo, Japan

[21] Appl. No.: 796,134

[22] Filed: Feb. 6, 1997

[30] Foreign Application Priority Data

Feb. 16, 1996 [JP] Japan ..... 8-029525

[51] Int. Cl.[6] ..... H01R 13/60

[52] U.S. Cl. ..... 439/157; 439/372

[58] Field of Search ..... 439/152–160, 439/372

[56] References Cited

U.S. PATENT DOCUMENTS

| | | | |
|---|---|---|---|
| 5,257,942 | 11/1993 | Taguchi | 439/157 |
| 5,344,194 | 9/1994 | Hatagishi et al. | 439/157 |
| 5,476,390 | 12/1995 | Taguchi et al. | 439/157 |
| 5,575,671 | 11/1996 | Katsuma | 439/157 |
| 5,603,624 | 2/1997 | Taguchi et al. | 439/157 |

FOREIGN PATENT DOCUMENTS

| | | |
|---|---|---|
| 63-2375 | 1/1988 | Japan . |
| 5-13129 | 1/1993 | Japan . |
| 5-3059 | 1/1993 | Japan . |
| 5-129048 | 5/1993 | Japan . |
| 7-307183 | 11/1995 | Japan . |

*Primary Examiner*—Hien Vu

*Attorney, Agent, or Firm*—Finnegan, Henderson, Farabow, Garrett & Dunner, L.L.P.

[57] ABSTRACT

A female connector for engagement with a male connector housing is provided. The female connector includes a female connector housing and a lever. The connector housing has a pair of axle parts formed to project from sidewalls. The lever is provided with a pair of bearing bores into which the axle parts are to be inserted. At a leading end of each axle part, a push projection is formed to extend perpendicular to the axle parts. Each bearing bore is provided with an insertion notch for allowing the push projection to pass. The insertion notch is positioned such that the push projection touches a solid part of the lever at its rotational beginning and end positions that the lever can occupy. Further, the insertion notch is also positioned such that the push projection passes above the insertion notch on the lever's rotational path to the end position. By this arrangement, the lever can be prevented from slipping out of the axle parts of the female connector housing.

4 Claims, 4 Drawing Sheets

LEVER ACTION-TYPE FEMALE CONNECTOR

BACKGROUND OF THE INVENTION

The present invention relates to a female connector which comprises a female connector housing and a lever pivotally attached to the female connector housing for easily fitting a male connector by rotating the lever. More particularly, it relates to the female connector which is capable of preventing the lever from falling out of the female connector housing during the transportation of the female connector.

In the prior art, there is a female connector which includes a synthetic female connector housing having an axle part projecting from a sidewall and a synthetic manipulating lever having a sidewall provided with a bearing bore to be fitted to the axle part. The axle, part is provided at a leading end of the female connector with two opposing flattened faces which are arranged in parallel with each other. The manipulating lever is provided with a guide notch which communicates with the bearing bore and through which the flattened faces of the axle part can pass.

In order to fit the female connector housing to a male connector housing the lever, biased by a spring or the like, is initially maintained in an upright posture where the axle part is inserted and fitted into the bearing bore.

Next, a plurality of projections on the male connector housing are engaged into guide recesses formed on the female connector housing and simultaneously engaged into cam grooves formed on the lever. Thereafter, the lever is rotated with respect to the female connector housing.

Consequently, with the rotation of the lever, the male connector housing can be drawn into the female connector housing smoothly and finally, the female connector housing and the male connector housing are combined into one body. Simultaneously, the lever is engaged in a locking part provided in the female connector housing, so that it is possible to avoid an undesirable rotation of the lever to cause the female connector housing to be detached from the male connector housing.

In the above-mentioned conventional connecting structure, however, often the lever is accidentally detached from the female connector housing due to an external force, oscillations to the female connection during the transportation or the assembling process of wireharnesses.

SUMMARY OF THE INVENTION

It is therefore an object of the present invention to provide a lever action-type female connector which is capable of preventing the lever from falling out of a female connector housing in particularly, the so-called "subassembling" condition that the female connector has not been fitted to the male connector yet.

The object of the present invention described above can be accomplished by a female connector for engagement with a male connector housing, the female connector comprising, in combination:

a female connector housing having a pair of axle parts formed to project form sidewalls of the female connector housing laterally;

and a lever to be pivotally attached to the female connector housing, the lever having at least one cam recess for engagement with a projection formed on the male connector housing and a pair of bearing bores into which the pair of axle parts of the female connector housing are inserted, respectively;

wherein each of the axle parts is provided, at a leading end thereof, with a push projection extending perpendicular to each of the axle parts;

wherein each of the bearing bores is provided with an insertion notch through which the push projection can pass.

In the present invention, preferably, the insertion notch is positioned in a manner that the push projection bears on a solid part of the lever in a beginning position of rotational movement of the lever and in an end position of the rotational movement of the lever and similarly, the insertion notch is positioned in a manner that the push projection passes above the insertion notch on said lever's rotational path to the end position.

With the arrangement mentioned above, when transporting the female connector while the lever is in the beginning position and when fitting the female connector housing to the male connector housing perfectly while the lever is in the end position, the push projections are brought into contact with the sidewalls of the lever. Therefore, the lever can be prevented from slipping out of the axle parts of the female connector housing. Further, since a positional coincidence of the push projections with the insertion notches is nothing but just a moment on the lever's path to the end position, it is expected that the lever is not detached from the female connector housing.

In the present invention, it is preferable that the lever is provided with an engagement hook while the female connector housing is provided with at least one engagement rib for engagement with the engagement hook and that the engagement hook is so adapted as to engage with the engagement rib in the beginning position of the lever's rotational movement.

In such a case, since the rotation of the lever is locked in the beginning position of the movement, the detaching can be doubly prevented.

More preferably, the axle parts and the push projections are provided with slanted guide faces for facilitating an engagement of the lever with the female connector housing.

In this case, the slanted guide faces allow the bearing bores and the insertion notches of the lever to be engaged with the axle parts and the push projections of the female connector housing smoothly. Accordingly, the attaching of the lever to the female connector housing can be facilitated.

Preferably, the lever is composed of a pair of sidewalls and a handling part bridging the sidewalls, thereby providing a substantial U-shaped configuration and the engagement hook is formed on the handling part.

More preferably, the female connector housing is provided with at least one wire leading pipe into which a wire is to be inserted and wherein the engagement rib is formed on the periphery of the wire leading pipe.

Preferably, the lever has a pair of cam recesses formed on the sidewalls respectively, and wherein each of the bearing bores is disposed in the vicinity of each of the cam recesses.

These and other objects and features of the present invention will become more fully apparent from the following description and appended claims taken in conjunction with the accompanying drawing.

DESCRIPTION OF THE PREFERRED EMBODIMENT

Figure 1:
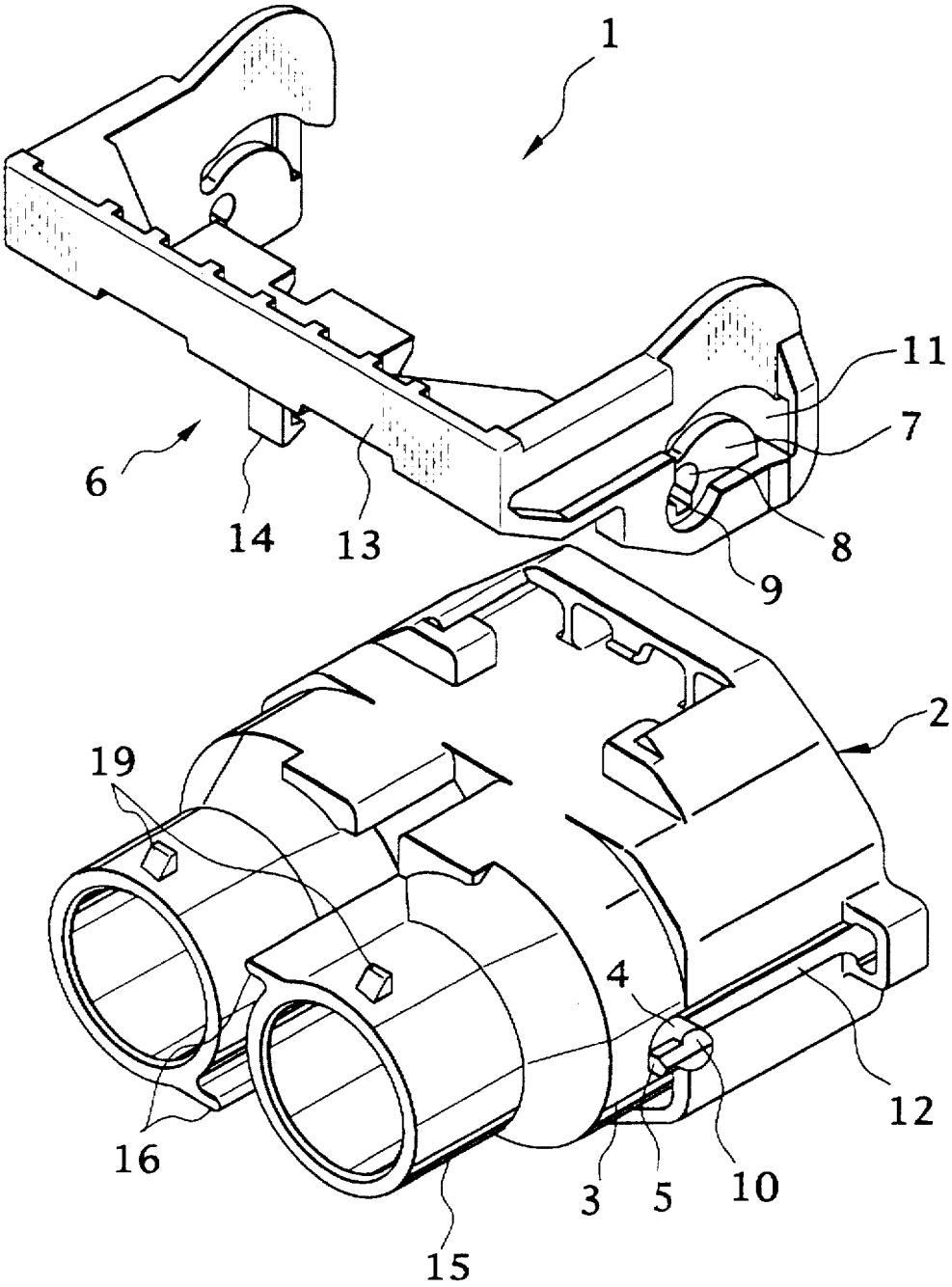
FIG. 1 is an exploded perspective view of a lever action type connector in accordance with an embodiment of the present invention.

An embodiment of the present invention will be described with reference to the drawings. FIGS. 1 to 7 show a lever action-type female connector in accordance with one embodiment of the present invention. As shown in FIG. 1, the female connector 1 of the invention comprises a female connector housing 2 and a U-shaped manipulating lever 6. The female connector housing 2, made of synthetic resinous material, has a pair of axle parts 4 (only one visible in the figure) formed so as to project from opposing sidewalls 3 of the female connector housing 2 laterally. At respective leading ends of the axle parts 4, push projections 5 are integrally formed so as to point backward of the female connector housing 2 in perpendicular to the axle parts 4.

The manipulating lever 6, also made of synthetic resinous material, is composed of a pair of sidewalls 7 and a handling part 13 bridging the sidewalls 7, providing a substantial U-shaped configuration. Formed in each sidewall 7 of the lever 6 is a bearing bore 8 into which each[] axle part 4 is to be inserted. Adjacent to each bearing bore 8, an insertion hole (notch) 9 is also formed so as to extend from the bore 8 radially and outwardly in order to permit the push projection 5 of the female connector housing 2 to pass through the hole 9.

Figure 2:
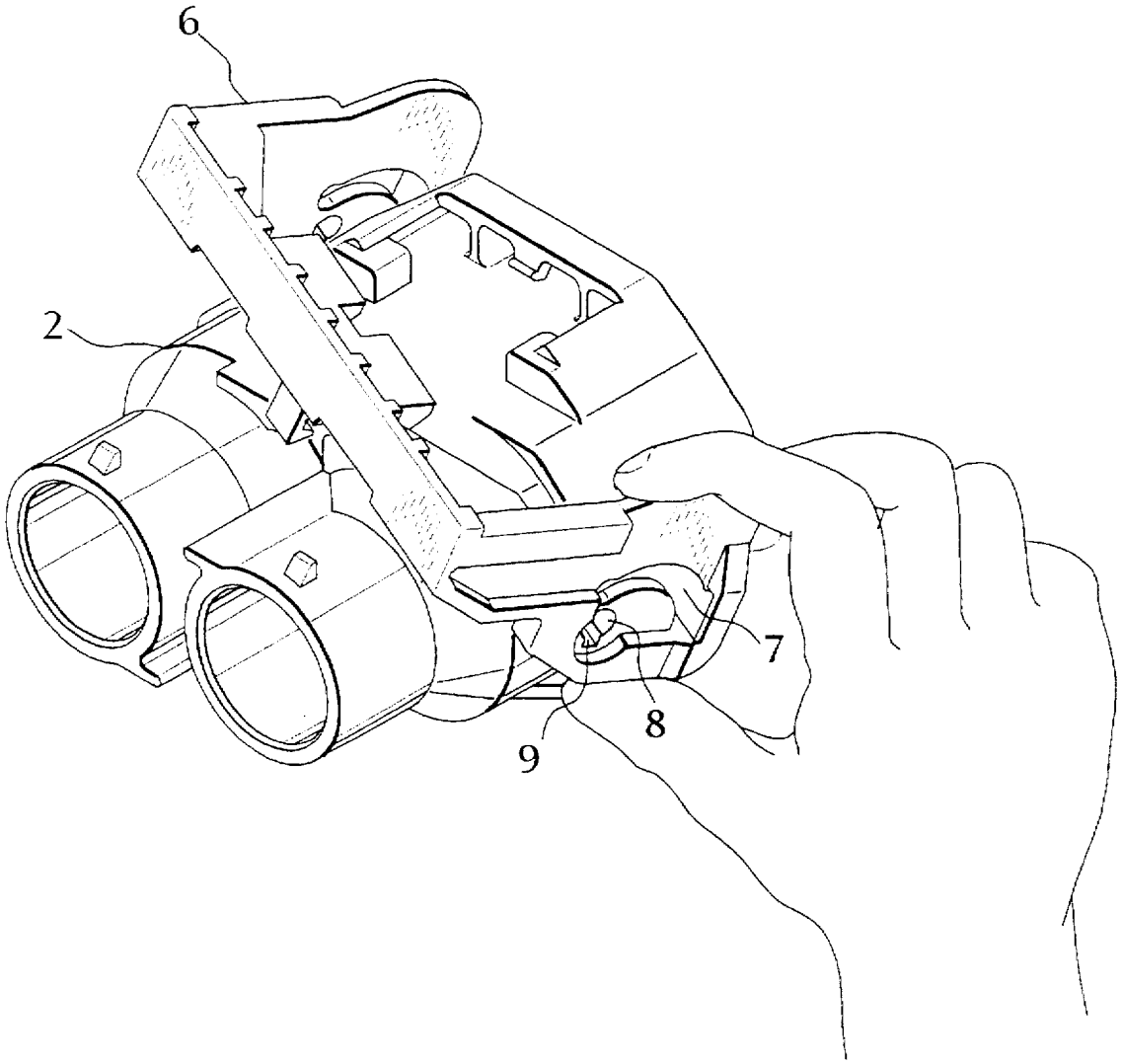
FIG. 2 is a perspective view showing a condition that a lever constituting the connector of the invention is being attached to a connector housing thereof.

As shown in FIG. 1, when the lever 6 is in a horizontal position, the insertion holes 9 are arranged to direct downwardly and perpendicularly to the lever 6. As it will be apparent from FIG. 4, each axle part 4 is shaped columnar, while each push projection 5 is formed to be a rectangular column having a width S which is smaller than a diameter D of the axle part 4;. In addition, both of the axle part 4 and the push projection 5 has a taper-shaped common guide face 10 on their respective upper half portions. Because of the guide faces 10 on both sides of the female connector housing 2, it is possible for an operator to carry out an operation of fitting the bearing bores 8 and the insertion holes 9 to the axle parts 4 and the projections 5, respectively, by easily expanding the sidewalls 7 of the lever 6 outwardly, as shown in FIG. 2. Each bearing bore 8 is circular-shaped while each insertion hole 9 is shaped rectangular, providing a key-hole configuration by the bearing bore 8 and insertion hole 9.

On the top side of the bearing bores 8 and the insertion holes 9 in FIG. 1, the lever 6 includes respective cam recesses 11 formed on the sidewalls 7 for engagement with driven projections 29 (FIG. 3) on a male connector housing 28. The female connector housing 2 has guide grooves 12 formed on the sidewalls 3 in front of the axle parts 4.

Both of each bearing bore 8 and each insertion hole 9, as well as the cam groove 11, are formed on the sidewall 7 which is lowered with respect to an outside wall 7 of the lever 6. Further, the lever 6 is provided, at a center of the handling part 13, with a flexible engagement hook 14 projecting downwardly. On the other hand, the female connector housing 2 includes a pair of wire leading pipes 15 formed so as to project backward and provided with respective engagement ribs 16 for engagement with the flexible engagement hook 14. The engagement of the hook 14 with the ribs 16 can be released by manipulating the lever 6.

Figure 3:
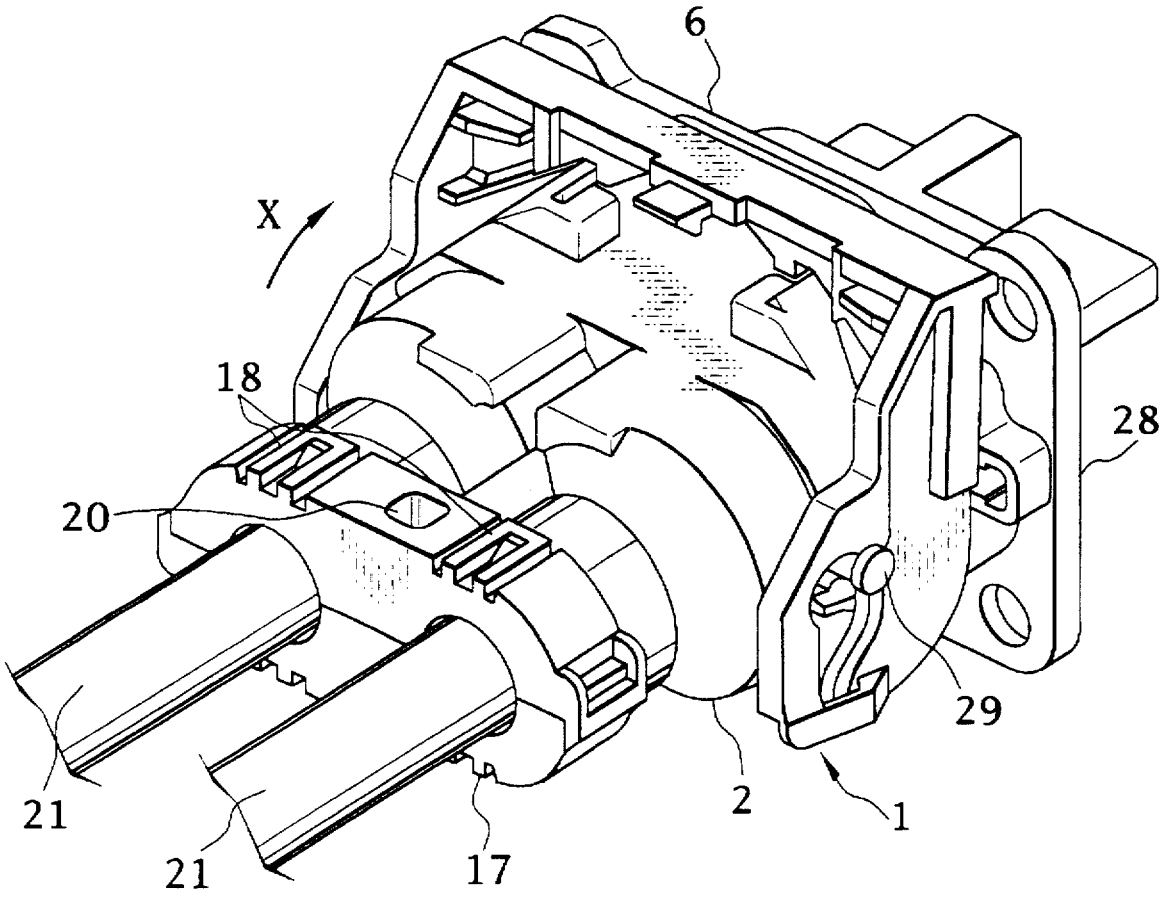
FIG. 3 is a perspective view showing a perfect fitting condition of the connector.

The engagement ribs 16 are formed so as to project from the upper and lower peripheral parts of the wire leading pipes 15 inwardly and diagonally. Consequently, the engagement ribs 16 can serve as stabilizer plates when a rear holder 17 of FIG. 3 is assembled to the connector housing 2. Thus, under such an assembled condition, the disengaging of the rear holder 17 from the connector housing 2 due to the assembly's oscillation can be prevented since the engagement ribs 16 abut on the inner wall of the rear holder 17. The wire leading pipes 15 are provided with engagement projections 19 for engagement with engagement frames 18 formed on the rear holder 17. The rear holder 17, constructed separably, serves to prevent waterproof rubber plugs (not shown in Figs.) on the wire leading pipes 15 from slipping out. The rear holder 17 is provided with a through hole 20 into which the engagement hook 14 is to be inserted.

Figure 4:
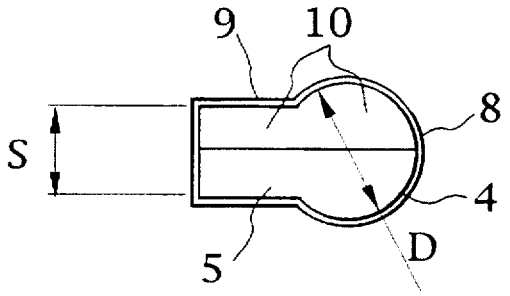
FIG. 4 is a front view showing a condition that a projection of an axle part of the connector housing is inserted into a bearing bore of the lever.

Under a condition that the lever 6 stands upright, the lever 6 is mounted onto the female connector housing 2 by adjusting the bearing bores 8 and the insertion holes 9 to the axle parts 4 and the push projections 5, as shown in FIG. 4.

Figure 5:
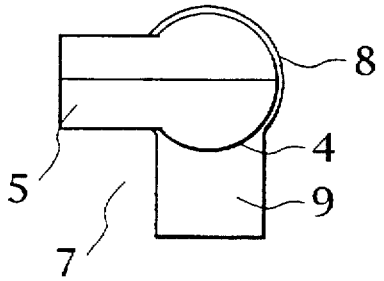
FIG. 5 is a front view showing a relationship in position between the projection and the bearing bore at a position where the lever has begun to rotate.
Figure 6:
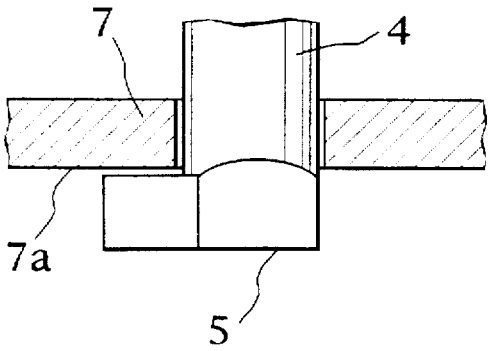
FIG. 6 is a cross sectional view showing a condition that the projection abuts on a sidewall of the lever.

Next, the lever 6 is pivoted to its horizontal position, i.e. a beginning position of its pivotal movement (see FIG. 1) so that each insertion hole 9 makes a right angle with each push projection 5 as shown in FIG. 5. Under such a condition, so-called a subassembling condition, each push projection 5 of the female connector housing 2 is brought into contact with or overlapped with a surface 7*a* of the sidewall 7 of the lever 6 with a slight clearance, as shown in FIG. 6. Consequently, since the sidewalls 7 are pressed by the projections 5, the dismounting of the lever 6, i.e. the disengagement of the bearing bores 8 from the axle parts 4, can be prevented.

In the beginning position of the lever 6, the engagement hook 14 engages with the engagement rib 16 of the female connector housing 2, so that the lever 6 is locked horizontally. Therefore, because of the push projections 5 and the engagement hook 14, the lever 6 can be prevented from dismounting from the female connector housing 2. According to the embodiment, while keeping such a condition, the female connector 1 will be carried or transported to the wire-harness assembling process. Additionally, electrical wires 21 of FIG. 3, a waterproof plug (not shown) and the rear holder 17 will be assembled to the female connector housing 2 during the assembling process.

Figure 7:
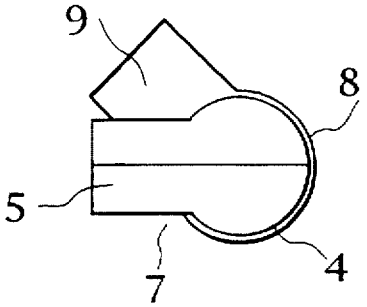
FIG. 7 is a front view showing a relationship in position between the projection and the bearing bore at a position where the rotation of the lever has been finished.

In the perfect fitting condition of FIG. 3 where the lever 6 is forwardly rotated along a direction of X to reach its end position, the lever 6 leans somewhat forward, so that each insertion hole 9 is slightly above each push projection 5, as shown in FIG. 7. Under such a condition, as well as the above subassembling condition, the disengaging of the lever 6 from the female connector housing 2 can be prevented since the push projections 5 depress the sidewalls 7 of the lever 6.

It should be noted that when the subassembled female connector 1 is carried or even when the lever 6 is operationally rotated, positions of the push projections 5 and the insertion holes 9 coincides at only a brief moment during the lever's path to the end position. In other words, the projections 5 almost always abut on the sidewalls 7 of the lever 6; therefore, the detachment of the lever from the female connector housing 2 during the manipulation of the lever 6 can be prevented certainly.

Furthermore, since the female connector 1 of the invention does not require a spring, which has been required in the conventional connector to realize its subassembled condition, the cost of manufacturing the connector 1 can be saved due to reduction of parts.

Finally, it will be understood by those skilled in the art that the foregoing description is one of preferred embodiments of the disclosed female connector, and that various changes and modifications may be made to the present invention without departing from the spirit and scope thereof.

What is claimed is:

1. A female connector for engaging a male connector housing, said female connector comprising;

a female connector housing having a pair of L-shaped axle parts projecting in an axial direction laterally from sidewalls, the female connector having at least one wire leading pipe integrally extending therefrom and an engagement rib formed on the periphery of said wire leading pipe;

a lever pivotally attachable to said female connector housing, said lever having at least one cam recess for engaging a projection formed on said male connector housing and a pair of side walls, each having a bearing bore for receiving a respect one of said axle parts of said female connector housing, said lever having a handling part briding said side walls thereby providing a substantial U-shaped configuration and an engagement hook on said handling part for latching with said engagement rib;

each of said axle parts having, at a leading end thereof, a push projection extending in a direction perpendicular to the axial direction of each of said axle parts; and each of said bearing bores having an insertion notch to define a key-hole configuration through which said axle parts can pass.

2. A female connector as claimed in claim 1, wherein said insertion notch is positioned in a manner that said push projection faces a surface of said lever at a beginning position of rotational movement of said lever and at an end position of the rotational movement of said lever, and said push projection and said insertion notch are positioned in a manner that said push projection passes by said insertion notch on a rotational path of said lever to the end position.

3. A female connector as claimed in claim 1, wherein said axle parts and said push projections are provided with slanted guide faces for facilitating an engagement of said lever with said female connector housing.

4. A female connector as claimed in Claim 1, wherein said lever has a pair of cam recesses formed on said sidewalls respectively, and wherein each of said bearing bores is disposed in the vicinity of each of said cam recesses.

* * * * *